United States Patent [19]

Furey et al.

[11] Patent Number: 4,719,009

[45] Date of Patent: Jan. 12, 1988

[54] SILICA DEPRESSANT IN FROTH FLOTATION OF SULFIDE ORES

[75] Inventors: James T. Furey; Richard J. Lobban, both of Kimberley, Canada; Michael Palmer, Kingsport, Tenn.

[73] Assignees: Cominco Ltd., Rochester, Canada; Eastman Kodak Company, British Columbia, N.Y.

[21] Appl. No.: 882,946

[22] Filed: Jul. 7, 1986

[51] Int. Cl.[4] ..... B03D 1/02

[52] U.S. Cl. ..... 209/167; 75/2; 252/61

[58] Field of Search ..... 209/166, 167; 75/2; 252/61

[56] References Cited

U.S. PATENT DOCUMENTS

| | | | |
|---|---|---|---|
| 2,373,305 | 4/1945 | Giescke | 209/166 |
| 2,689,045 | 9/1954 | Fischer | 209/166 |
| 2,732,940 | 1/1956 | Hall et al. | 209/166 |

FOREIGN PATENT DOCUMENTS

| | | | |
|---|---|---|---|
| 749213 | 5/1956 | United Kingdom | 209/167 |

*Primary Examiner*—S. Leon Bashore
*Assistant Examiner*—Thomas M. Lithgow
*Attorney, Agent, or Firm*—Neil F. Markva

[57] ABSTRACT

Certain water dissipatable polyester materials containing ether groups and metal sulfonate groups are useful as depressants for siliceous gangue in the froth flotation separation of zinc sulfide concentrates from complex ores containing, minerals of other metals such as lead and iron, as well as various silicon compounds. The polyester materials ae effective in amounts ranging from about 0.03 to about 1.5 kg/tonne of ore feed. Zinc rougher concentrates when conditioned with the depressant yields zinc cleaner concentrates containing less than about 1.5% silica without the need for extensive regrinding of the rougher concentrate. Particularly useful polyester material is prepared from an acid component of from about 80 to 85 mole % isophthalic acid with the remainder comprising mainy 5-sodiosulfoisopthalic acid, and a diol component of from about 50 to 60 mole % diethylene glycol with the remainder comprising mainly 1.4-cyclohexanedimethanol.

9 Claims, No Drawings

SILICA DEPRESSANT IN FROTH FLOTATION OF SULFIDE ORES

BACKGROUND OF THE INVENTION

This invention relates to the froth flotation separation of sulfide minerals from their ores and, more specifically, concerns the depression of undesirable gangue comprising mainly siliceous materials in the froth flotation of complex metal sulfide ores for the concentration of zinc sulfide.

In the recovery of mineral concentrates from ores by froth flotation, particularly of zinc sulfide concentrates from comminuted complex sulfide ores, the ores typically are subjected to a number of operations in interconnected flotation circuits often including crushing, grinding, and regrinding of intermediate flotation products. These operations ultimately result in separation of the gangue in tailing fractions and the formation of concentrates predominant in the desired mineral such as zinc sulfide.

The flotation circuits typically include one or more rougher, cleaner and recleaner flotation stages with conditioning of the feed thereto by reagents selected to effect separations between desired mineral species and from undesired gangue. These reagents comprise collectors, depressants, activators, deactivators, frothers and the like. The depressants include a depressant for gangue material which contains, for example, silica, quartz, lead or iron silicates or the like. The gangue depressant is added to feed slurry at one or more points in the flotation circuit separate from or together with other reagents. The amount of depressant employed is dependent on the amount of gangue in the feed to the flotation circuit, and to some extent also on the amount of zinc sulfide in the feed. This gangue, if not removed, would interfere severely with subsequent processing of the zinc sulfide concentrate, such as in the roasting, leaching or electrowinning. Consequently, the level of the gangue as measured by silica content in the concentrate should be limited to below about 1.5% by weight of the dried solids, higher levels of gangue rendering the concentrate unsuitable for efficiency recovery of zinc.

Gangue depressants known to the art include carboxymethylcellulose and ethylcellulose, glue, gelatin, acid, starch and dextrin. Also, A. M. Gaudin (Flotation, 2nd Ed., McGraw-Hill, 1957) mentions that silica or quartz can be deactivated by soda ash, sodium silicate or an alkali phosphate, and that other agents occasionally found useful are tartrates, citrates and dyes, especially highly hydroxylated hydroquinone dyes. A. F. Taggart (Handbook of Mineral Dressing, John Wiley & Sons Inc., N.Y., 1945) mentions several reagents for depressing silica and silicates in mineral flotation. Additional disclosures of depressants are as follows: U.S. Pat. No. 4,220,525 teaches that polyhydroxy amines are useful as depressants for silica, silicate, carbonate, sulfate and phosphate gangue materials; U.S. Pat. No. 4,339,331 teaches that nonsulfide materials are depressed with a crosslinked starch or starch-containing substance having anhydroglucose cross-linking units; U.S. Pat. No. 2,919,802 discloses that mannogalactan is useful as a depressant for slimes and in particular that an alkali metal phosphate or silicate is a depressant for slimes that accompany sulfide ores; and U.S. Pat. No. 2,373,305 discloses that citric acid, tannic acid or quebracho are useful as gangue depressants.

These known depressants are often found to be effective only in the treatment of certain specific ores due to the presence of salts in the water, the characteristics of ionic impurities associated with the siliceous gangue materials and other empirical factors, poorly understood.

SUMMARY OF INVENTION

Objects, therefore, of the present invention are: to provide an improved means for depressing gangue in the froth flotation of complex ores; to provide an improved process for the froth flotation separation of zinc sulfide containing complex sulfide ores; to provide an improved froth flotation process for obtaining a zinc sulfide concentrate low in siliceous gangue; and to provide a froth flotation process for obtaining a zinc sulfide concentrate wherein the flotation feed ore can be relatively coarse.

These and other objects hereinafter appearing have been attained in accordance with the present invention through the discovery that certain water dissipatable polyesters containing ether groups and metal sulfonate groups are excellent depressants for gangue in the froth flotation separation of zinc sulfide concentrates from complex sulfide ores, and that through the use of these polyesters it is not necessary for the flotation feed ore to be in as finely divided a form as otherwise required.

The invention is defined in its broad sense, therefore, as comprising a froth flotation process for concentrating zinc sulfide from complex sulfide ores containing siliceous gangue materials wherein the flotation is carried out in an aqueous system in the presence of a depressant for siliceous gangue materials, said depressant consisting of water dissipatable polyester material containing ether groups and metal sulfonate groups and having an inherent viscosity in the range of about 0.1 to 1.5, said material being dispersed in said aqueous system and acting to depress said gangue materials therein.

Preferably, the polyester material comprises: (a) a first acid component comprising at least one acid selected from aliphatic, cycloaliphatic and aromatic dicarboxylic acids; (b) a diol component comprising at least one diol having from about 2 to about 28 carbon atoms, at least about 20 mole percent of which is poly(ethylene glycol) having the formula $H-(OCH_2CH_2)_nOH$ wherein n is an integer of from 2 to about 14; and (c) a second acid component comprising at least one difunctional dicarboxylic acid containing a $-SO_3M$ group attached to an aromatic nucleus, wherein M is hydrogen, $Na^+$, $Li^+$ or $K^+$, said second acid component constituting at least about 8 mole percent to about 45 mole percent of the total moles of said first and second acid components, and wherein said polyester material has an inherent viscosity in the range of about 0.4 to 0.6 determined according to ASTM D2857-70 procedure in a Wagner Viscometer of Lab Glass Inc. of Vineland, N.J. having a ½ ml. capillary bulb, using a polymer concentration of 0.5% by weight in 60/40 by weight, phenol/tetrachloroethane solvent. Preferably, the depressant is added in an amount in the range of about 0.03 to 1.5 kg/tonne of ore feed to the flotation for the recovery of zinc sulfide concentrate.

DETAILED DESCRIPTION

The useful water dissipatable polyesters are among those disclosed in U.S. Pat. Nos. 3,734,874, 3,779,993 and 4,148,779. The polyester materials useful in the process of the present invention comprise: (a) a first acid component comprising at least one acid selected from aliphatic, cycloaliphatic and aromatic dicarboxylic acids; (b) a diol component comprising at least one diol having from about 2 to about 28 carbon atoms, at least about 20 mole percent of which is poly(ethylene glycol) having the formula $H\text{-}(OCH_2CH_2)_nOH$ wherein n is an integer of from 2 to about 14; and (c) a second acid component comprising at least one difunctional dicarboxylic acid containing a $-SO_3M$ group attached to an aromatic nucleus, wherein M is hydrogen, $Na^+$, $Li^+$ or $K^+$, said second acid component constituting at least about 8 to about 45 mole percent of the total moles of said first and second acid components. The polyester materials have inherent viscosities in the range of about 0.1 to 1.5, preferably about 0.4 to 0.6. The inherent viscosities (I.V.) of the water dissipatable polyesters are determined according to ASTM D2857-70 procedure in a Wagner Viscometer of Lab Glass Inc. of Vineland, N.J. having a ½ ml. capillary bulb, using a polymer concentration of 0.5% by weight in 60/40 by weight, phenol/tetrachloroethane solvent. The procedure comprises heating the polymer/solvent system at 120° C. for 15 minutes to enhance dissolution of the polymer, cooling the solution to 25° C. and measuring the time of flow at 25° C. The I.V. is calculated from the equation $$(\eta)^{25°C}_{0.50\%} = \frac{\ln \frac{t_s}{t_o}}{C}$$

where:

($\eta$)=I.V. at 25° C. at a polymer concentration of 0.5 g./100 ml. of solvent;

ln=Natural logarithm;

$t_s$=Sample flow time;

$t_o$=Solvent-blank flow time; and

C=Concentration of polymer in grams per 100 ml. of solvent=0.50.

The I.V. values given herein are in deciliters/gram.

In the preferred polyester material, the first acid component is isophthalic acid and the second acid component is 5-sodiosulfoisophthalic acid, while the diol component comprises an amount of diethylene glycol with the remaining amount being mainly 1.4-cyclohexanedimethanol. Preferably, the polyester material comprises isophthalic acid in an amount in the range of about 75 to 95 mole %, more preferably of about 80 to 85 mole %, 5-sodiosulfoisophthalic acid in an amount in the range of about 25 to 5 mole %, more preferably of 20 to 15 mole %, and a diol component comprising of from about 40 to about 65 mole %, more preferably from about 50 to about 60 mole %, diethylene glycol with the remainder being mainly 1.4-cyclohexanedimethanol. Most preferably, the polyesterdepressant comprises about 82 mole % isophthalic acid, about 18 mole % 5-sodiosulfoisophthalic acid, and a diol component comprising about 54 mole % diethyleneglycol and about 46 mole % 1.4 cyclohexanedimethanol.

The complex sulfide ores that may be treated according to the present invention contain zinc sulfides such as sphalerite, lead sulfides such as galena and other metal sulfides such as those of iron, copper, arsenic, antimony, bismuth, cadmium and the like, mixed with gangue materials.

In multiple stage flotation systems, the amount of the present depressant added to a flotation cell can be as low as about 0.03 kg/tonne of feed depending on the amount of siliceous gangue materials therein. The total amount of the water-dissipatable polyester depressant for the entire system usually does not exceed about 1.5 kg/tonne of feed to the flotation circuit. The amount of depressant added, therefore, can be in the range of about 0.03 to 1.5 kg/tonne of feed, although lesser or greater amounts may be used depending on the particular flotation system employed. For zinc sulfide containing complex sulfide ores which contain fairly high levels, e.g., about 40 to about 50% siliceous gangue materials, the depressant is preferably added to the stage of cleaner flotation of the zinc sulfide concentrate. In a preferred embodiment of the overall flotation process, a rougher flotation stage and a cleaner flotation stage are included and the polyester depressant is added to the cleaner flotation stage in an amount in the range of about 0.1 to 0.5 kg/tonne of feed thereto. In this preferred embodiment the rougher concentrate is conditioned with the depressant in amounts in the range of about 0.1 to 0.5 kg/tonne of feed.

The zinc sulfide flotation is carried out according to conventional practice with the circuit operated at a pH controlled at values in the range of about 5 to 11, the pH value being dependent on the origin and composition of the ore. For example, the flotation circuit for a siliceous zinc-lead sulfide ore from Alaska is operated preferably at a pH value in the range of about 5 to 7. The ore feed is finely divided and the feed to the cleaner and recleaner flotation stages is normally reground to further liberate the desired mineral. In zinc sulfide flotation using conventional depressants, regrinding must be carried out to a degree such that about 80% of the solids in the flotation feed slurry are smaller than about 19 micron in order to obtain a satisfactory gangue rejection in the tailing. When using the present depressants, however, we have found that regrinding to a degree whereby 80% of the particles are smaller than about 27 micron (80% $<27\mu$) is sufficient for depressing the gangue materials in the tailing to give a zinc sulfide concentrate containing less than about 1.5% silica. The coarser regrind also effects lower energy requirements and yields zinc sulfide concentrates that are acceptable to more smelters.

The invention will now be illustrated by means of the following nonlimitative examples.

EXAMPLE 1

A sample of a lead, zinc and iron-containing complex sulfide ore from Alaska containing gangue materials including 47% silica and quartz was ground and subjected to froth flotation operations to obtain a lead sulfide concentrate and a zinc sulfide rougher concentrate using reagents conventionally used to obtain such concentrates. The zinc sulfide rougher concentrate comprised 36.21% by weight of the original ore sample and assayed 3.1% Pb, 44.9% Zn and 6.4% Fe with a distribution of 18.9% Pb, 83.5% Zn and 55.0% Fe. A sample of this zinc sulfide concentrate was reground so that 80% $<27\mu$ and the reground material was divided in two equal portions A and B for evaluation of one of the present polyester depressants. This polyester, PE-1, was composed of a first acid component of about 82 mole % isophthalic acid and a second acid component of about 18 mole % 5-sodiosulfoisophthalic acid, and a diol component of about 54 mole % diethylene glycol and about 46 mole % 1.4-cyclohexanedimethanol. Portion A was conditioned for 10 minutes with 0.014 kg/t MIBC (methyl isobutylcarbinol) frothing agent and portion B was conditioned for 10 minutes with 0.014 kg/t of MIBC and 0.49 kg/t of PE-1. Both conditioned portions were subjected to four sequential cleaner flotation stages, the concentrate from one flotation stage being the feed for the next. The pH values of the concentrates ranged from 5.3 to 5.5.

The assays and calculated distributions of the final concentrates form the fourth cleaner flotation stage are given in Table I.

TABLE I

| Portion | % wt* | Assay % Pb | Zn | Fe | Insol | SiO2 | Distribution % Pb | Zn | Fe | Insol |
|---|---|---|---|---|---|---|---|---|---|---|
| A | 53.58 | 3.4 | 57.7 | 4.0 | 2.3 | 2.1 | 57.7 | 68.8 | 33.3 | 7.9 |
| B | 50.99 | 3.0 | 59.4 | 3.7 | 1.3 | 1.2 | 50.6 | 67.5 | 29.4 | 4.1 |

*weight of fourth concentrate as % of total weight of portion.

The results show that the use of PE-1 (Portion B) depresses silica effectively with retention of grade of the final concentrate. These experiments also show that a regrind of the rougher concentrate to 80% <27μ is sufficient to give a satisfactory concentrate grade.

EXAMPLE 2

Three portions of a zinc sulfide rougher concentrate prepared from the ore used in Example 1 and reground to 80% <27μ were subjected to a cleaner flotation operation using different amounts of PE-1 as gangue depressant. The rougher concentrate contained 1.4% Pb, 50% Zn and 6.6% Fe. The concentrations of PE-1, the silica contents of the cleaner flotation concentrates, and the zinc recoveries are tabulated in Table II.

TABLE II

| Portion | PE-1 kg/t | $SiO_2$ % | Zn Recovery % |
|---|---|---|---|
| 1 | 0.131 | 1.0 | 83 |
| 2 | 0.264 | 0.7 | 84.8 |
| 3 | 0.396 | 0.65 | 85.3 |

It is thus apparent that PE-1 in amounts ranging from 0.1 to about 0.5 kg/t is effective in reducing the content of siliceous gangue material in the final zinc sulfide concentrate to well below the usually specified highest acceptable level of 1.5% $SiO_2$.

EXAMPLE 3

Three different samples A, B and C from the same ore as in Example 1 were each subjected to flotation operations to obtain a zinc rougher concentrate having a particle size of about 80% <27μ. Each concentrate, which was not reground, was split into two portions. One portion was conditioned with an amount of PE-1 and the other portion served as a nonconditioned control. All portions were subjected to four stages of cleaner flotation and the silica content and zinc recovery of each fourth stage cleaner concentrate determined. The results are given in Table III.

TABLE III

| Sample | Concentrate Grade Pb % | Zn % | Fe % | PE-1 kg/t | $SiO_2$ % | Zn Recovery % |
|---|---|---|---|---|---|---|
| A | 3.9 | 38 | 10.4 | nil | 2.0 | 61 |
| | | | | 0.400 | 1.3 | 58 |
| B | 1.8 | 44 | 8.9 | nil | 2.7 | 73.5 |
| | | | | 0.445 | 2.3 | 84.6 |

TABLE III-continued

| Sample | Concentrate Grade Pb % | Zn % | Fe % | PE-1 kg/t | $SiO_2$ % | Zn Recovery % |
|---|---|---|---|---|---|---|
| C | 3.7 | 38.3 | 10.3 | nil | 4.7 | 64.9 |
| | | | | 0.392 | 3.4 | 68.4 |

These experiments show that, although addition of the present polyester depressant lowers the silica content in the final cleaner concentrates, regrinding of the rougher concentrate to 80% <27μ is desirable for obtaining silica levels in said cleaner concentrates equivalent to those obtained in Examples 1 and 2.

It is noted that extensive testwork with the ore used in the above Examples and using known silica depressants described hereinabove, showed that these known depressants were ineffective in depressing siliceous gangue materials.

We claim:

1. A froth flotation process for concentrating zinc sulfide from complex sulfide ores containing siliceous gangue materials wherein the flotation is carried out in an aqueous system in the presence of a depressant for siliceous gangue materials said depressant consisting of water-dissipatable polyester material containing ether groups and metal sulfonate groups and having an inherent viscosity in the range of about 0.1 to 1.5 deciliters per gram, said polyester material being dispersed in said aqueous system and acting to depress said gangue materials therein.

2. The process of claim 1, wherein the polyester material comprises:

(a) a first acid component comprising at least one acid selected from aliphatic, cycloaliphatic and aromatic dicarboxylic acids;

(b) a diol component comprising at least one diol having from about 2 to about 28 carbon atoms, at least about 20 mole percent of which is poly(ethylene glycol) having the formula $H—(OCH_2CH_2-)_nOH$ wherein n is an integer of from 2 to about 14; and (c) a second acid component comprising at least one difunctional dicarboxylic acid containing a $—SO_3M$ group attached to an aromatic nucleus, wherein M is hydrogen, $Na^+$, $Li^+$ or $K^+$, said second acid component constituting at least about 8 mole percent to about 45 mole percent of the total moles of said first and second acid components; and wherein said polyester material has an inherent viscosity in the range of about 0.4 to 0.6 deciliters per gram determined according to ASTM D2857-70 procedure in a Wagner Viscometer of Lab Glass Inc. of Vineland, N.J. having a ½ ml. capillary bulb, using a polymer concentration of 0.5% by weight in 60/40 by weight, phenol/tetrachloroethane solvent.

3. The process of claim 2, wherein said first acid component is isophthalic acid in an amount in the range of about 75 to 95 mole %, said second acid component is mainly 5-sodiosulfoisophthalic acid in an amount in the range of about 25 to 5 mole %, and said diol component comprises diethylene glycol in an amount in the range of about 40 to 65 mole % with the remainder being mainly 1,4-cyclohexanedimethanol.

4. The process of claim 3, wherein the isophthalic acid is present in an amount in the range of about 80 to 85 mole %, the 5-sodiosulfoisophthalic acid is present in an amount in the range of about 20 to 15 mole %, and said diol component comprises about 50 to about 60 mole % diethylene glycol with the remainder being 1.4 cyclohexanedimethanol.

5. The process of claim 1, 2, or 3, wherein the depressant for siliceous gangue materials is added in an amount in the range of about 0.03 to 1.5 kg/tonne of ore feed to the flotation for the recovery of zinc sulfide concentrate.

6. The process of claim 1, 2, or 3 wherein the flotation for the recovery of zinc sulfide concentrate includes rougher flotation and cleaner flotation and wherein the depressant for siliceous gangue materials is added to the cleaner flotation in an amount in the range of about 0.1 to 0.5 kg/tonne of feed to the cleaner flotation.

7. The process of claim 4, wherein the complex sulfide ore comprises sulfides of lead, zinc and iron and siliceous gangue materials; said flotation includes flotation to obtain first a zinc rougher concentrate and then a zinc cleaner concentrate; the zinc rougher concentrate is conditioned with the depressant for siliceous gangue materials in an amount in the range of about 0.1 to 0.5 kg per tonne of rougher concentrate; said depressant comprises about 82 mole % isophthalic acid, 18 mole % 5-sodiosulfoisophthalic acid, and a diol component of about 54 mole % diethylene glycol and about 46 mole % 1.4-cyclohexanedimethanol; and the conditioned rougher concentrate is subjected to cleaner flotation to obtain a zinc sulfide cleaner concentrate with a reduced content of said gangue materials.

8. The process of claim 7, wherein the zinc sulfide cleaner concentrate contains less than about 1.5% silica.

9. The process of claim 7 or 8, wherein the zinc sulfide rougher concentrate is reground prior to conditioning with said depressant to a degree such that 80% of the particles are smaller than about 27 micron.

* * * * *

UNITED STATES PATENT AND TRADEMARK OFFICE

CERTIFICATE OF CORRECTION

PATENT NO. : 4,719,009

DATED : January 12, 1988

INVENTOR(S) : James T. Furey et al

It is certified that error appears in the above-identified patent and that said Letters Patent is hereby corrected as shown below:

On the title page, line [73], change the assignees' cities as follows:

Cominco Ltd., British Columbia, Canada;

Eastman Kodak Company, Rochester, N.Y.

Signed and Sealed this

Nineteenth Day of July, 1988

*Attest:*

DONALD J. QUIGG

*Attesting Officer*

*Commissioner of Patents and Trademarks*